US008292761B2

(12) United States Patent
Krawczyk

(10) Patent No.: US 8,292,761 B2
(45) Date of Patent: Oct. 23, 2012

(54) TRAINING DEVICE AND METHOD FOR GUIDING A BALL THROWING MOVEMENT

(75) Inventor: Raymond Allen Krawczyk, Alios Viejo, CA (US)

(73) Assignee: Throwtrac Enterprises, Inc, Wildomar, CA (US)

( * ) Notice: Subject to any disclaimer, the term of this patent is extended or adjusted under 35 U.S.C. 154(b) by 0 days.

(21) Appl. No.: 13/385,499

(22) Filed: Feb. 23, 2012

(65) Prior Publication Data

US 2012/0214619 A1 Aug. 23, 2012

Related U.S. Application Data

(63) Continuation of application No. 12/462,454, filed on Aug. 4, 2009, now abandoned.

(60) Provisional application No. 61/188,735, filed on Aug. 12, 2008.

(51) Int. Cl.
*A63B 69/00* (2006.01)

(52) U.S. Cl. ..... 473/451; 473/430

(58) Field of Classification Search ..... 473/422, 473/423, 430, 451–456, 424, 428
See application file for complete search history.

(56) References Cited

U.S. PATENT DOCUMENTS

| | | | | | |
|---|---|---|---|---|---|
| 5,441,255 | A * | 8/1995 | Verbick | 473/55 |
| 5,595,384 | A * | 1/1997 | Hardison, Jr. | 473/453 |
| 5,895,327 | A * | 4/1999 | Francisco | 473/229 |
| 6,165,110 | A * | 12/2000 | Gajda | 482/102 |
| 6,666,781 | B1 * | 12/2003 | Illis | 473/453 |
| 7,056,224 | B1 * | 6/2006 | Keyes | 473/257 |
| 7,131,916 | B2 * | 11/2006 | Griffin | 473/417 |
| 7,217,202 | B2 * | 5/2007 | Troxell | 473/451 |
| 7,517,290 | B1 * | 4/2009 | Springer | 473/422 |
| 2004/0132557 | A1 * | 7/2004 | Broglio et al. | 473/422 |
| 2006/0089212 | A1 * | 4/2006 | Marchel | 473/422 |

* cited by examiner

*Primary Examiner* — Mark Graham

(57) ABSTRACT

A training device guides the throwing arm of a person in a ball throwing movement in a forward throwing direction. The training device comprises a base arranged to be supported on the ground, an upright support member extending upwardly from the base and a guide member on the upright support member which has a generally concave inner surface extending upwardly and forwardly from a generally vertical starting end to a generally horizontal releasing end. The user grasps a ball in the hand of their throwing arm and displaces the ball alongside the guide member from the starting end to the releasing end in a ball throwing movement to throw the ball in the forward throwing direction of the training device.

14 Claims, 6 Drawing Sheets

TRAINING DEVICE AND METHOD FOR GUIDING A BALL THROWING MOVEMENT

This application is continuation of U.S. parent application Ser No. 12/462,454, filed Aug. 4, 2009, now abandoned and claims the benefit under 35 U.S.C. 119(e) of U.S. provisional application Ser. No. 61/188,735, filed Aug. 12, 2008.

FIELD OF THE INVENTION

The present invention relates to a training device and method of use for training a ball throwing movement by guiding the movement of the throwing arm of the person. More particular, the present invention relates to a guide member for guiding a ball, for example a baseball or a softball, in a hand of the throwing arm of the person along an upward and forward curved path in a forward throwing movement.

BACKGROUND

Most kids, for example ages 6 to 12, have not been taught or know how to properly throw a baseball or softball in the correct manner. The kids end up throwing a baseball or softball with their elbows down below there shoulder which in the long run will develop bad habits which could be vital to their arms as they get older. Kids have a hard time changing their arm slot to throw a baseball or softball as they reach age thirteen and up.

SUMMARY OF THE INVENTION

According to one aspect of the invention there is provided a method of guiding a throwing arm of a person in a ball throwing movement in a forward throwing direction, the method comprising:

providing a guide member extending between a starting end and a releasing end;

supporting the guide member such that the guide member curves upwardly and forwardly in the forward throwing direction from the starting end positioned rearwardly of the person to the releasing end spaced above a head of the person; and displacing the hand of the throwing arm of the person alongside the guide member from the starting end of the guide member to the releasing end of the guide member in a ball throwing movement.

According to a second aspect of the present invention there is provided a training device for guiding a ball throwing movement of a person in a forward throwing direction, the device comprising:

a base arranged to be supported on a supporting surface;

a guide member having a generally concave inner surface arranged to receive a ball slidably therealong between a starting end and a releasing end of the guide member;

an upright support member arranged to support the guide member on the base at a location spaced upwardly from the ground such that the inner surface of the guide member is curved upwardly and forwardly into the forward throwing direction from the starting end to the releasing end.

The device and method of the present invention relate to a teaching aid that will help kids or persons practice the proper arm technique along with developing their deltoid muscle and muscle memory. This teaching aid will also help develop and allow the kids to keep their elbow higher than their shoulder so that they learn to throw properly. More particularly, the present invention relates to a teaching aid that will help kids from ages 6 to 12 which are the critical ages to get their arm in the proper arm slot to throw. The proper arm slot is to have the elbow higher than the shoulder when throwing a baseball or softball. This teaching aid will help the kids develop their deltoid muscle that is crucial for keeping the elbow higher than the shoulder, along with muscle memory. This teaching aid teaches them to get their arm position in the right slot to throw a baseball or softball.

The method preferably includes locating the starting end of the guide member near a height of a shoulder of the person, positioning the starting end of the guide member to be near vertical in orientation, and positioning the releasing end of the guide member to be near horizontal in orientation.

Preferably the guide member follows a curve substantially located in a vertical plane parallel to the forward direction such that the guide member has a concave inner surface facing the person and having a substantially constant radius from the starting end to the releasing end.

The method may further comprise placing a ball in the hand of the throwing arm of the person and sliding the ball along the guide member from the starting end to the releasing end. The ball is preferably positioned in the hand of the throwing arm of the person such that only the ball engages the guide member. The ball is typically released from the hand of the throwing arm of the person after the ball is disengaged from the guide member. The person preferably places their feet spaced apart along a forward axis extending in the forward throwing direction from the starting end of the guide member.

The guide member is preferably supported by the upright support member at an adjustable height relative to the base on the ground such that the height of the guide member can be adjusted relative to the person.

In some embodiments, the guide member comprises two side members oriented parallel and spaced apart from one another to receive a ball therebetween in which both side members extend between the starting end and the releasing end of the guide member. Alternatively the guide member may comprise a flat surface between opposing side edges, or a concave surface between the opposing side edges which extend in the forward working direction from the starting end to the releasing end.

The upright support member may be arranged to be readily releasable from the guide member and the base for collapsibility into a stored position, or for accepting other related devices on the base.

In one embodiment there is provided a ball support member arranged to be supported on the base interchangeably with the upright support member in which the ball support member is arranged to support a baseball thereon at a batting height when the ball support member is supported on the base.

In another embodiment there is provided a swing training device arranged to be supported on the base interchangeably with the upright support member.

Alternatively, the swing training device may be arranged to be supported on the upright support member together with the guide member at a location spaced laterally outwardly from the upright support member. In this instance, the swing training device comprises a depending member extending downwardly from a top end supported on the guide member for relative pivotal movement about a horizontal pivot axis lying parallel to the forward throwing direction and a target member supported on the depending member spaced below the guide member so as to be arranged to be supported at a batting height.

The guide member may be formed of a material having a low coefficient of friction to engage the ball in the hand of the user for relative sliding therebetween.

The starting end of the guide member is preferably arranged to be supported directly on the upright support member. In this instance there may be provided an auxiliary support member extending between the upright support member and the releasing end of the guide member arranged to be supported at a location spaced horizontally outward from the upright support member.

The base may comprise a hollow member including a fill port formed therein so as to be arranged to receive ballast material therein. Alternatively, the base may include a plurality of stake receiving apertures formed therein, the stake receiving apertures being arranged to receive ground penetrating stakes therein for securement of the base to the ground.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
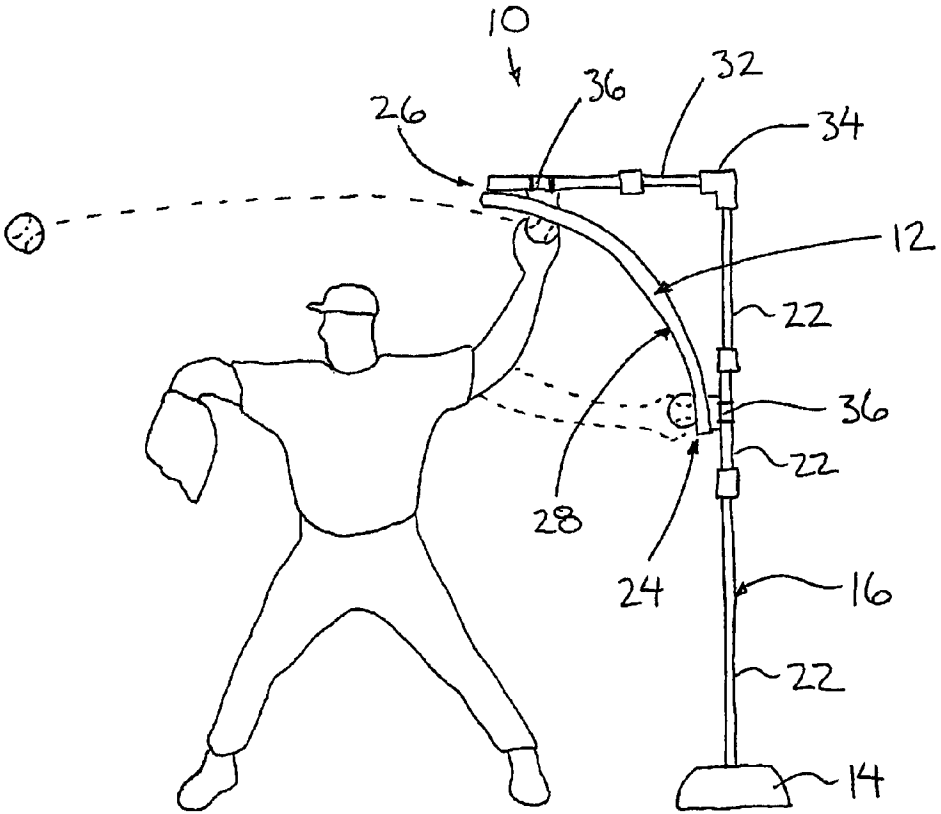
FIG. 1 is a side elevational view of the training device.

Referring to the accompanying figures there is illustrated a training device generally indicated by reference numeral 10. The device is 10 is particularly suited for guiding a throwing arm of a person throwing a ball in a forward direction.

The device 10 generally comprises a guide member 12 which is arranged to guide the movement of the hand of the throwing arm of the user during a ball throwing movement. The guide member 12 is supported spaced above a base 14 on the ground by an upright supporting member 16 extending upwardly from the base to the guide member 12.

Figure 2:
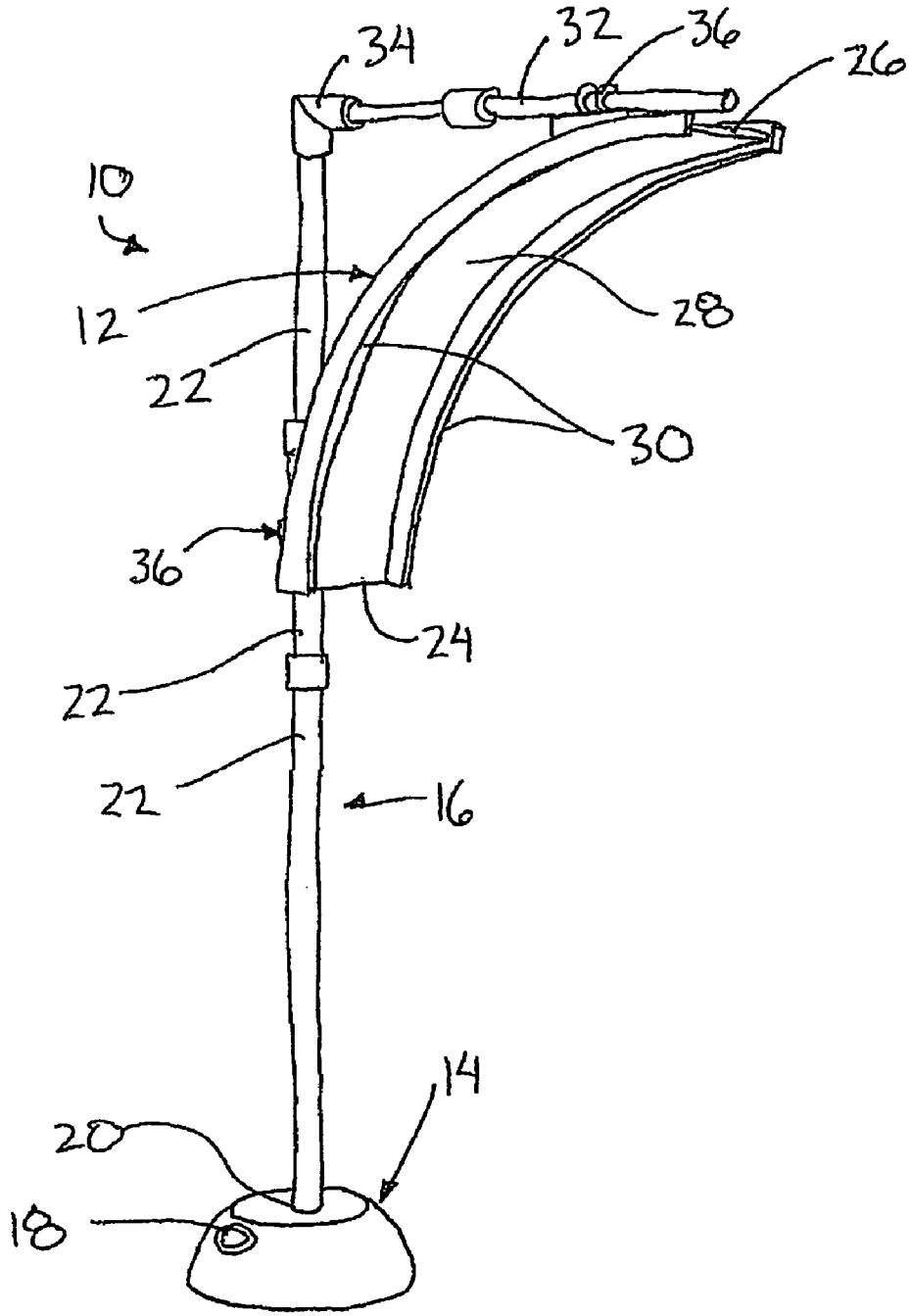
FIG. 2 is a perspective view of the training device.

Turning now to FIGS. 1 and 2, a first embodiment of the device 10 will now be described. The base 14 in this instance generally comprises a hollow member including a fill port 18 adjacent the top end thereof through which a ballast material, for example water or sand can be inserted into the hollow interior of the base to securely support the base in a proper orientation on the ground in use. The base may further be provided with a plurality of stake apertures formed therein which are arranged to receive ground penetrating stakes therethrough for additional securement of the base in place in fixed relation to the ground. The base further includes a central socket 20 arranged to releasably receive a lower end of the upright support member 16 therein in a mounted position in use.

The upright support member 16 comprises a plurality of individual sections 20 which are assembled relative to one another to form a rigid vertical pole received in the central socket 20 at the bottom end thereof and supporting the guide member 12 thereon at a location spaced upwardly from the bottom end towards the top end. The plurality of sections 22 forming the upright support member are arranged to be telescoped relative to one another for adjusting an overall height of the upright and accordingly adjusting a height of the guide member 12 relative to the ground. Furthermore the plurality of sections 22 can be collapsed relative to one another by readily separating the sections from one another, from the base, and from the guide member 12 for storage as may be desired.

The guide member 12 extends between a starting end 24 and a releasing end 26. A concave inner surface 28 of the guide member is arranged to be curved upwardly and forwardly from the starting end to the releasing end 26 when mounted in use. At the starting end, the inner surface 28 is arranged to face forwardly in the throwing direction in a near vertical orientation.

Alternatively the releasing end 26 in use is arranged to face downwardly in a near horizontal orientation extending generally in the forward throwing direction. When the hand of a throwing arm of the user of the training device is displaced alongside the guide member from the starting end to the releasing end, the throwing movement of the user is effectively guided from a position rearward of the user to a position spaced above a head of the user during the windup portion of a ball throwing movement.

The guide member 12 includes two side members 30 which are mounted parallel and spaced apart from one another from the starting end to the releasing end of the guide member. The central portion of the inner surface of the guide member spanning between the two side members is arranged to be recessed in relation to the two side members and is generally flat to define a trough which receives a ball therein between the two side members. The two side members and the central portion spanning therebetween are integrally formed with one another of a material having a low coefficient of friction so that a ball can be readily slid along the inner surface of the guide member from the starting end to the releasing end in use.

The starting end of the guide member is supported directly on the upright support member 16 at a location spaced between the top and bottom ends thereof. An auxiliary support member 32 is also provided which is coupled between the top end of the upright support member and the releasing end of the guide member at a location spaced horizontally outward in the forward throwing direction from the upright support member. A suitable socket connection 34 is provided between the auxiliary support member 32 and the upright support member 16 so as to permit ready attachment and ready separation of the support members relative to one another.

The guide member includes suitable brackets 36 at the opposing ends thereof for securement to the auxiliary support members 32 and the upright support member 16 respectively. The brackets 36 as well as all of the connections between different sections of the upright support member, between the upright support member and the base, between the upright support member and the auxiliary support member, and between any other components, all permit some relative adjustment therebetween for adjusting the height and inclination of the guide member 12 relative to the ground and the user as well as permitting all of the components to be readily separated and readily reattached to one another for collapsing into storage and reassembly for subsequent use as may be desired.

In further embodiments the base and upright support member may comprise a tripod construction or other suitable structure including a plurality of legs extending radially outward from a common central support upon which the guide member is mounted. When providing a base having a plurality of legs, separate feet may be provided for indoor or outdoor use, for example rubber or gripping material for indoor use and suitable ground penetrating spikes or other members for outdoor use.

The upright support member 16 may also comprise various configurations of lightweight yet structurally supporting materials including aluminium, carbon fibre or other variations of plastics and the like for supporting the guide member spaced above the ground. Multiple sections of the frame comprising the upright support member 16 and the auxiliary support member 32 can be coupled relative to one another for relative adjustment by suitable twist locking collars when adjacent sections are telescoped relative to one another. Alternatively telescoping sections may be coupled relative to one another by providing a sprung pin member on one section for mating connection with a plurality of longitudinally spaced apertures in the other section slidably receiving the first section therein. Any suitable structure which permits adjustment of the height of the guide member relative to the ground would be satisfactory.

In the illustrated embodiment the guide member comprises a track of plastic material in which the two side members and the central portion forming the trough are integrally molded with one another. In further embodiments the guide member may be formed of any suitable material which is rigid or flexible, however when flexible in nature it is preferable that suitable supports are provided for coupling the guide member to the support members to maintain an upward and forward curving profile to adequately guide the ball throwing movement of the user. The configuration of the guide may also be varied to comprise a single channel which is V-shaped in cross section for example to receive different diameters of balls slidably therealong. In the alternative the guide member may comprise two parallel and spaced apart rod-like members which are spaced apart by a distance which is slightly less than the diameter of the ball to slidably guide the ball movement therealong between the two rods. In yet further embodiments the guide may comprise a track of a plurality of rollers to guide a ball therealong in a throwing movement from the starting end to the releasing end.

In either embodiment, the guide member is positioned spaced above the ground and relative to a user throwing in a forward direction so that the starting end is spaced rearwardly of the user near or just below a shoulder height of the user in a throwing stance. The remainder of the guide member is positioned to curve upwardly and forwardly towards the releasing end which is spaced above a head of the user and slightly rearward of the head of the user. The user then positions a ball in the hand of the throwing arm of the user with the ball being slidably engaged on the starting end of the guide member. The ball is slid along the inner surface of the guide member from the starting end to the releasing end during the windup portion of a ball throwing movement such that the hand of the throwing arm is displaced alongside the guide member. After the ball is disengaged from the guide member as the ball throwing movement continues beyond the releasing end of the guide member, the user subsequently releases the ball.

As described herein, the use of the invention involves first adjusting height of the guide member according to the height of the user. The selected height is locked in place by twisting the knob that is on the pole that it attached to the base. Once the knob is loosened, the pole will move up and down to allow the user to put the pole up to the right height. The pole may be marked with height increments corresponding to the age of a child using the device allowing the user to set the height according to the age of the user. Once the height it set, the user stands underneath the track in accordance with instructional images provided with the device. The preferred distance between the user and the training device corresponds to the user extending their throwing arm (right or left according to user preference) rearward towards the guide member such that a ball in the hand of the throwing arm slidably engages the starting end of the guide member. Their throwing arm should have a slight "L" shape when extended to the arch in according with further instructional images provided with the device. The user then would slide the ball up the track of the guide member while keeping the ball on the track so that the fingers do not engage the guide member. The palm of the hand of the throwing arm of the user should be facing down toward the ground at first, then as the ball is slid up the track the palm would be toward the sky or upward towards the releasing end of the track. The ball is thrown and released upon sliding beyond the releasing end of the guide member. This movement will help keep the elbow of the user higher than the shoulder of the user which will develop the deltoid muscle when throwing or not throwing. Practicing with the training device 10 without throwing or throwing will develop the muscle memory along with keeping the throwing elbow to stay higher than the shoulder as shown in the accompanying figures. A user would typically practice this throwing movement using the training device for at least 10 minutes each day whether the ball is thrown or not. Staying with 10 minutes a day would help reinforce the desired result of muscle memory keeping the elbows of the user higher than the shoulder.

Turning now to FIGS. 3 through 7, a further embodiment of the training device will be described. According to the embodiment of FIG. 3, the training device 10 is substantially identical to the previous embodiment with regard to the use of a guide member 12 extending upwardly and forwardly with a concave inner surface 28 from a vertical starting end 24 to a horizontal releasing end 26. The guide member is supported by an upright support member 16 above a base 14 having a central socket 20 therein which receives the upright support member 16 releasably and adjustably therein. An auxiliary support member 32 similarly provides additional support to the guide member for being supported on the upright support member 16 by use of a socket connection 34 therebetween.

Figure 3:
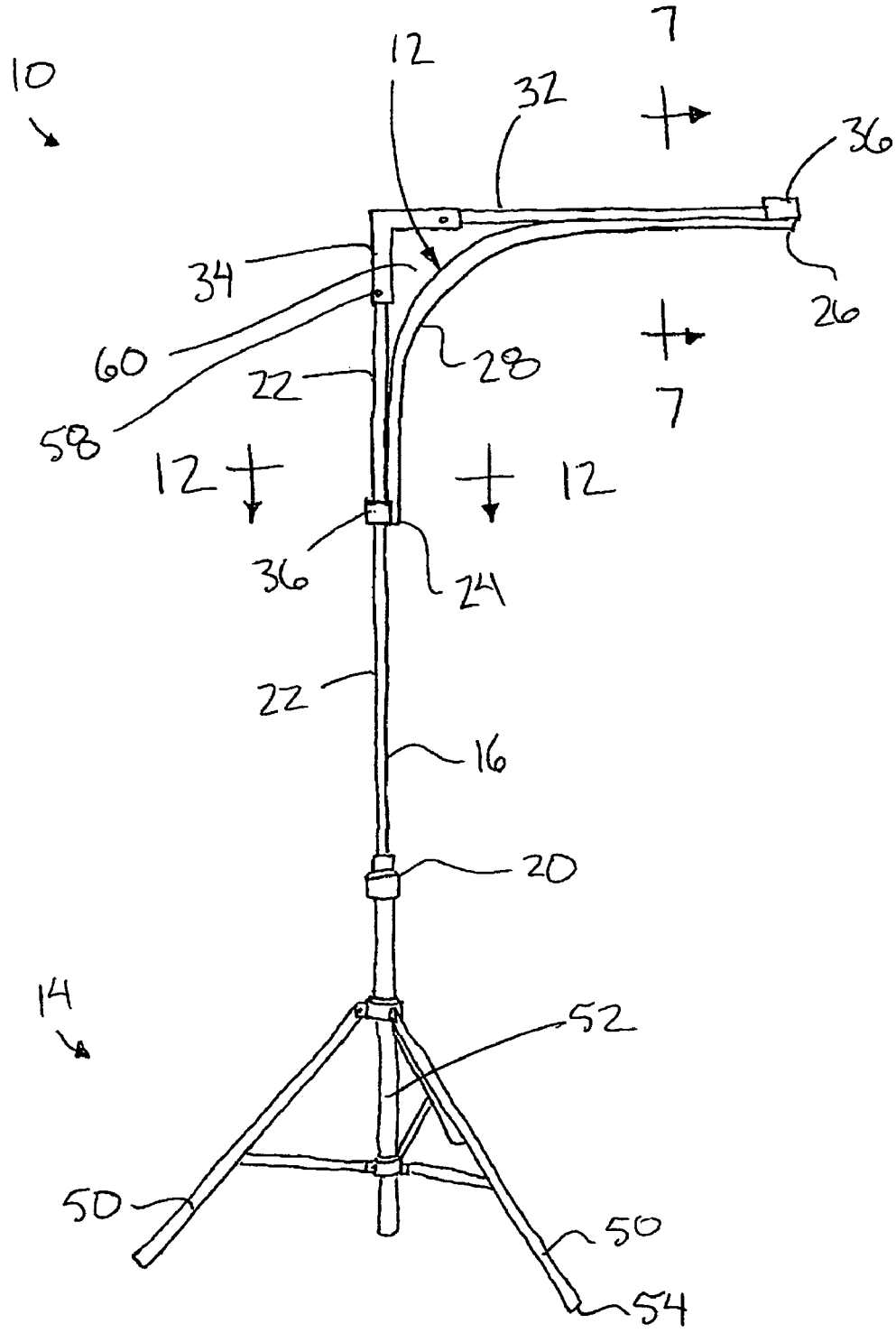
FIG. 3 is a perspective view of a further embodiment of the training device.
Figure 11:
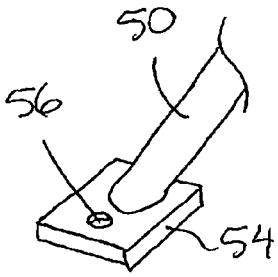
FIG. 11 is a perspective view of a further embodiment of the legs of the base of the training device.

The embodiment of FIG. 3 differs from the previous embodiment in that the base 14 comprises a tripod constructed of three legs 50 extending radially outward and downward from respective inner ends mounted on a central vertical post 52 to respective feet 54 at the lower outer ends of the legs. As shown in the enlarged view of FIG. 11, each of the feet 54 comprises a broad surface of larger dimensions than the leg to provide an increased gripping surface with the ground. A suitable stake opening 56 is provided in each foot 54 to receive a suitable ground penetrating stake for optional securement of the legs to the ground if desired. The legs 50 are hinged onto the central post by respective sliding collars arranged to be selectively fixed in position so that the legs can be selectively pivoted into a storage position lying parallel to and alongside the central post. The central socket 20 is located at the upper end of the central post 52 to slidably and telescopically receive a plurality of sections 22 of the upright support member 16 therein.

Figure 10:
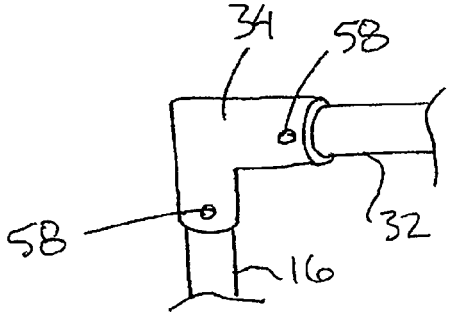
FIG. 10 is a perspective view of a portion of the upright support member upon which the guide member is supported according to a further embodiment.

As shown in the embodiment of FIG. 3, the uppermost section 22 of the upright support member 16 and the auxiliary support member 32 are again coupled at right angles to a socket connection 34 therebetween. As shown in further detail in FIG. 10, each of the opposed ends of the connection 34 comprises a socket to slidably receive the respective auxiliary support member 22 or upright support member 16 therein. Cooperating apertures are provided in the support members and the respective ends of the socket connection 34 to receive a resiliently mounted pin 58 through the cooperating apertures to selectively retain the support members within the socket connection. The pins 58 are internally supported in the ends of the support members to be biased into an engaged position received through the cooperating apertures while permitting the pins to be depressed and selectively released from the socket connection such that the support members are readily releasable from the socket connection.

To provide additional support the guide member, the guide member is provided with a suitable gusset 60 of material in which the reinforcing gusset spans a triangular space between the central portion of the guide member 28 and the socket connection 34 to maintain the central portion of the guide member along a prescribed curve for guiding the throwing movement.

Figure 12:
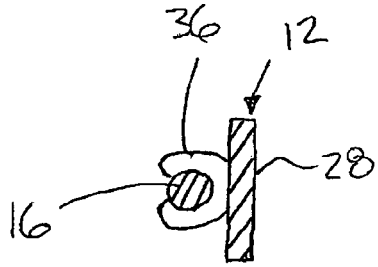
FIG. 12 is a sectional view along the line 12-12 of FIG. 3 of the guide member supported on the upright support member.

Opposing ends of the guide member can be mounted onto the corresponding upright or auxiliary support member using a suitable bracket 36 of the type shown in greater detail in FIG. 12 in which the bracket comprises a generally C-shaped clamp member arranged to be snap-fit about the support member. Each bracket 36 thus comprises a pair of opposed clamping portions which are biased towards one another into a clamping position in which the support member is clamped therebetween. The resilient nature of the opposed clamping portions of the bracket 36 permits the clamp to be released from the support member by flexing the two clamping portions away from one another. In this manner the guide member can be readily separated from the support members for disassembly into a stored position as may be desired.

Figure 4:
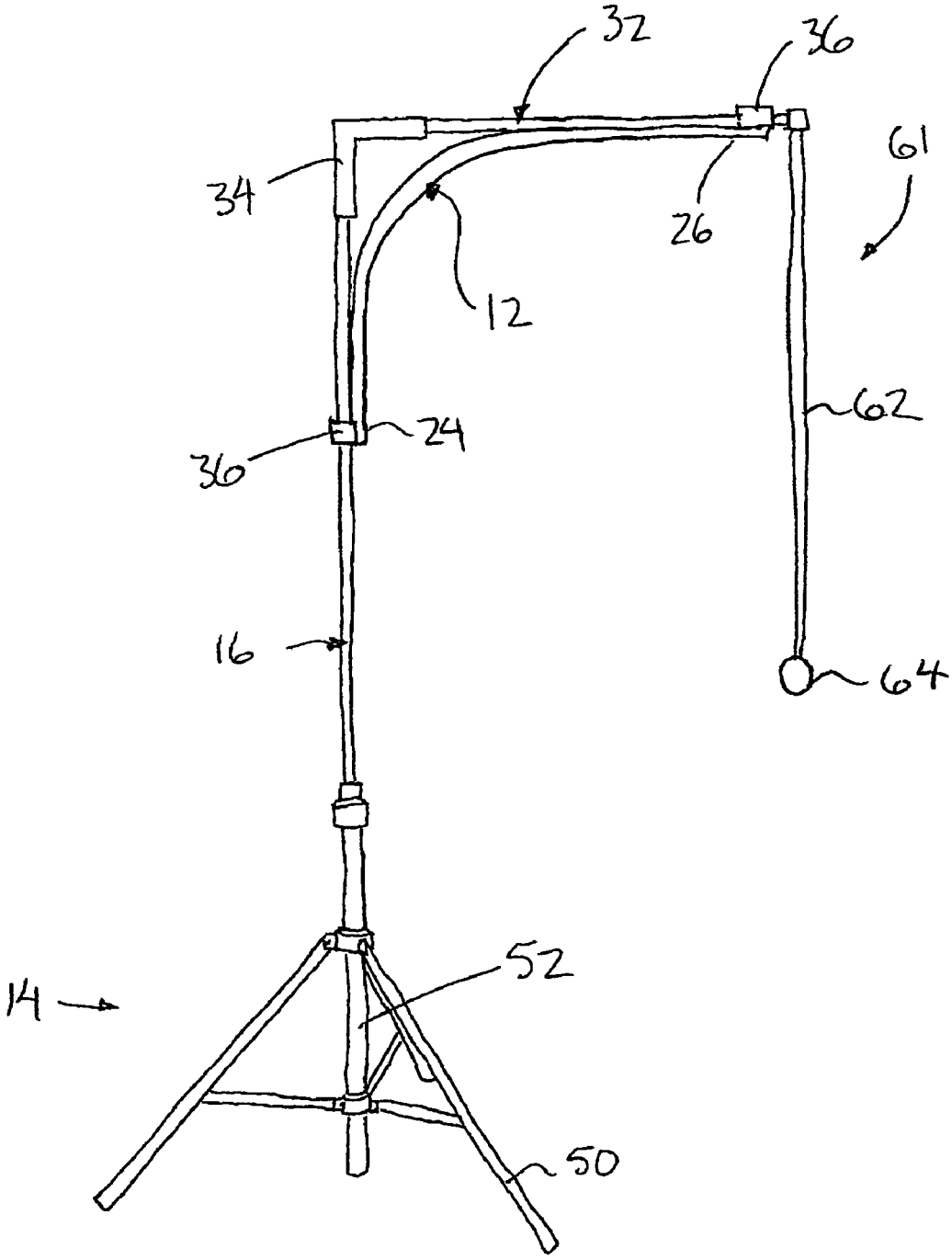
FIG. 4 is a perspective view of a swing training device supported on the base of the training device according to FIG. 3.

Turning now to the embodiment of FIG. 4, a swing training device 61 is shown supported by the auxiliary support member 32 on the upright support member 16 together with the guide member 12. More particularly the swing training guide comprises an elongate depending member 62, for example a flexible rod or tether which is mounted at an upper end at the releasing end of the guide member for pivotal movement about a horizontal pivot axis which extends parallel to the forward throwing direction. The depending member 62 extends downwardly to a bottom end supporting a target member 64 thereon spaced below the axis at the releasing end of the guide member. The target member typically comprises a baseball which is fixed onto the bottom end of the depending member 62. The depending member 62 has a suitable length such that the target member 64 is supported at an appropriate batting height for the user. The depending member 62 is permitted to rotate fully 360 degrees about the pivot axis relative to the guide member that when the target member is struck with a bat in a batting motion, the target member will be displaced in the batting direction by pivoting of the depending member to permit completion of the batting motion.

Figure 5:
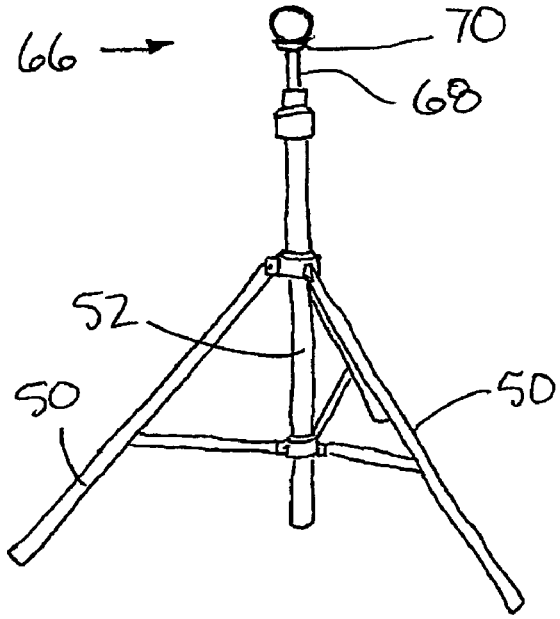
FIG. 5 is a perspective view of a ball support member supported on the base of the training device according to FIG. 3.
Figure 6:
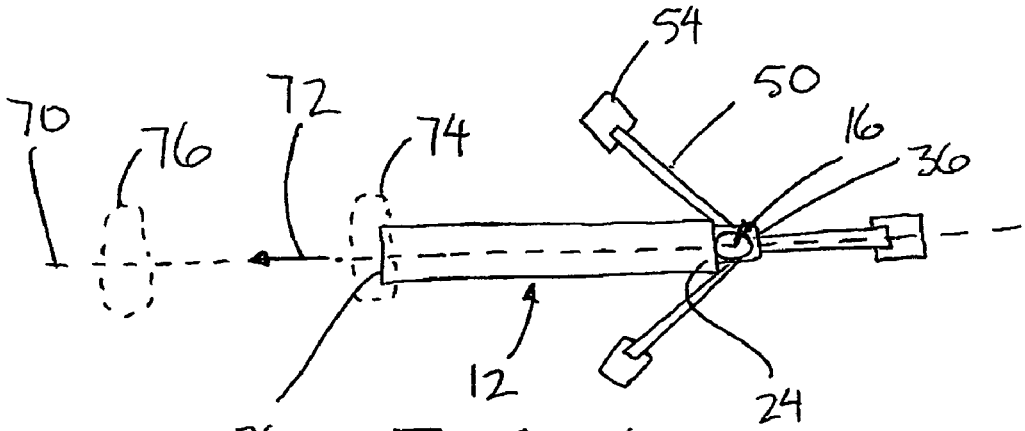
FIG. 6 is a top plan view of the training device in relation to a user arranged for throwing in the forward throwing direction.

As shown in FIG. 5, the upright support member supporting the guide member and the swing training device 61 can be slidably removed from the central socket of the post 52 on the base to interchangeably receive a ball support member 66 slidably therein in place of the upright support member of the guide member or the swing training device. The ball support member 66 comprises a vertical post 68 including a suitable cup 70 at the top end thereof having a concave upper surface of suitable size and dimension to receive a baseball therein. The baseball is supported at a batting height by the ball support member within the base with the connection between the ball support member post 68 and the central post of the base being adjustable in height to accommodate different user heights.

Figure 7:
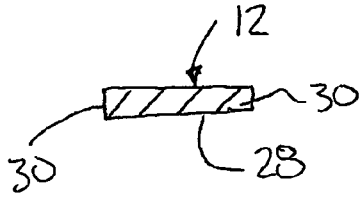
FIG. 7 is a sectional view of the guide member along the line 7-7 of FIG. 3.

As shown in FIG. 7, the inner surface 28 of the guide member can be substantially flat in cross section between opposing side edges 30.

Figure 8:
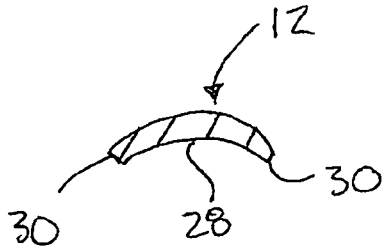
FIG. 8 is a sectional view similar to FIG. 7 of an alternative embodiment of the guide member.

Alternatively, as shown in FIG. 8, the inner surface 28 may also be concave in a lateral direction between the opposing side edges 30 which extend in the longitudinal direction of the guide member between the starting end and releasing end thereof. The inner surface is thus substantially trough shaped along the length of the guide member similar to the first embodiment.

Figure 9:
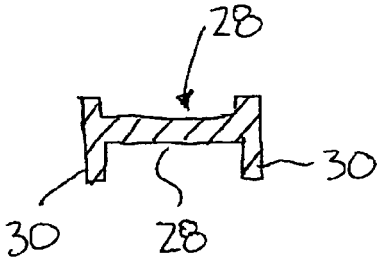
FIG. 9 is a sectional view similar to FIG. 7 of a further embodiment of the guide member.

FIG. 9 illustrates a typical cross section of the guide member according to the first embodiment of FIGS. 1 and 2 in which two side members 30 are shown depending from the opposing side edges of the substantially flat inner surface 28 of the guide member 12.

In some embodiments as described above the base 14 may be configured for mounting on various types of horizontal supporting surfaces such as the ground or a floor. In other embodiments, the base 14 may comprise a suitable bracket for attachment to an upright supporting surface or any suitable upright structure, for example a chain-link fence, a post or other upright wall structure. In the examples of chain-link fence or a post, the base 14 is preferably arranged for clamping engagement onto a portion of the fence or post so as to remain fixed in relation to the upright supporting surface.

In all embodiments, the user typically stands relative to the upright support member of the device 10 such that the two feet of the user are spaced apart along a forward longitudinal axis 70 extending in the forward throwing direction 72 from the starting end of the guide member at the centre of the base. A rear foot 74 of the user is approximately directly below the releasing end of the guide member with the lead foot 76 of the user being spaced in the forward direction farther from the training device than the rear trailing foot. In this manner as the user performs a throwing motion by sliding the ball along the inner surface of the guide member from the starting end to the releasing end, the ball becomes disengaged with the guide member substantially directly overtop of the user's head just prior to releasing the ball from the hand of the throwing arm of the person.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of guiding a throwing arm of a person in a ball throwing movement in a forward throwing direction, the method comprising:

providing a guide member extending between a starting end and a releasing end;

supporting the guide member such that the guide member curves upwardly and forwardly in the forward throwing direction from the starting end positioned rearwardly of the person to the releasing end spaced above a head of the person;

placing a ball in the hand of the throwing arm of the person;

sliding the ball along the guide member from the starting end to the releasing end such that only the ball engages the guide member by displacing the hand of the throwing arm of the person alongside the guide member from the starting end of the guide member to the releasing end of the guide member in a ball throwing movement; and releasing the ball from the hand of the throwing arm of the person only after the ball is disengaged from the guide member.

2. The method according to claim 1 including locating the starting end of the guide member near a height of a shoulder of the person.

3. The method according to claim 1 including positioning the starting end of the guide member to be near vertical in orientation.

4. The method according to claim 1 including positioning the releasing end of the guide member to be near horizontal in orientation.

5. The method according to claim 1 including supporting the guide member to follow a curve substantially located in a vertical plane parallel to the forward direction.

6. The method according to claim 1 including supporting the guide member such that the guide member has a concave inner surface facing the person and having a substantially constant radius from the starting end to the releasing end.

7. The method according to claim 1 including supporting the guide member at an adjustable height relative to the ground and adjusting the height of the guide member relative to the person.

8. The method according to claim 1 including placing the feet of the person spaced apart along a forward axis extending in the forward throwing direction from the starting end of the guide member.

9. The method according to claim 1 including supporting the guide member on a base such that the guide member is arranged to be readily releasable from the base.

10. The method according to claim 1 wherein the guide member comprises two side members oriented parallel and spaced apart from one another and extending between the starting end and the releasing end of the guide member, and wherein the method includes sliding the ball along the guide member between the two side members.

11. The method according to claim 1 including supporting the guide member on a base in which the base includes a plurality of stake receiving apertures formed therein and securing the base to the ground by inserting ground penetrating stakes into the stake receiving apertures.

12. The method according to claim 1 including supporting the guide member on a base and providing a ball support member arranged to be supported on the base interchangeably with the guide member in which the ball support member is arranged to support a baseball thereon at a batting height when the ball support member is supported on the base.

13. The method according to claim 1 including supporting the guide member on a base and providing a swing training device arranged to be supported on the base together with the guide member in which the swing training device comprising a depending member extending downwardly from a top end supported on the guide member for relative pivotal movement about a horizontal axis parallel to the forward throwing direction and a target member supported on the depending member spaced below the guide member so as to be arranged to be supported at a batting height.

14. A method of guiding a throwing arm of a person in a ball throwing movement in a forward throwing direction, the method comprising:

providing a guide member having a concave inner surface extending between a starting end and a releasing end;

supporting the guide member such that:

the guide member curves upwardly and forwardly in the forward throwing direction from the starting end positioned rearwardly of the person to the releasing end spaced above a head of the person; and the inner surface follows a curve having a substantially constant radius from the starting end to the releasing end and being substantially located in a vertical plane parallel to the forward direction;

positioning the starting end of the guide member to be near vertical in orientation and to be located near a height of a shoulder of the person;

positioning the releasing end of the guide member to be near horizontal in orientation with the concave inner surface facing the person;

placing a ball in the hand of the throwing arm of the person;

placing the feet of the person spaced apart along a forward axis extending in the forward throwing direction from the starting end of the guide member;

sliding the ball along the guide member from the starting end to the releasing end such that only the ball engages the guide member by displacing the hand of the throwing arm of the person alongside the guide member from the starting end of the guide member to the releasing end of the guide member in a ball throwing movement; and releasing the ball from the hand of the throwing arm of the person after the ball is disengaged from the guide member.

* * * * *